US010529167B2

(12) United States Patent
Khamphilapanyo et al.

(10) Patent No.: US 10,529,167 B2
(45) Date of Patent: Jan. 7, 2020

(54) DISPENSE EVENT VERIFICATION FOR DISPENSERS

(71) Applicant: GOJO Industries, Inc., Akron, OH (US)

(72) Inventors: Touby Khamphilapanyo, Cuyahoga Falls, OH (US); Aaron Kurchev, Atwater, OH (US); Michael Prediger, Rittman, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 14/967,714

(22) Filed: Dec. 14, 2015

(65) Prior Publication Data

US 2016/0171811 A1 Jun. 16, 2016

Related U.S. Application Data

(60) Provisional application No. 62/091,127, filed on Dec. 12, 2014.

(51) Int. Cl.

| | |
|---|---|
| ***A47K 5/12*** | (2006.01) |
| ***G07F 17/00*** | (2006.01) |
| ***G07F 17/18*** | (2006.01) |
| ***G07F 7/02*** | (2006.01) |
| ***G07F 7/08*** | (2006.01) |
| ***G07F 9/02*** | (2006.01) |

(52) U.S. Cl.

CPC ..... *G07F 17/0092* (2013.01); *A47K 5/1217* (2013.01); *G07F 7/025* (2013.01); *G07F 7/08* (2013.01); *G07F 9/023* (2013.01); *G07F 9/026* (2013.01); *G07F 17/0014* (2013.01); *G07F 17/18* (2013.01)

(58) Field of Classification Search

CPC ..... G07F 17/00; G07F 17/0092; G07F 17/18; A47K 5/1217

See application file for complete search history.

(56) References Cited

U.S. PATENT DOCUMENTS 4,663,621 A * 5/1987 Field ..... G07C 9/0069 221/154
5,106,337 A * 4/1992 Knox ..... G07D 3/04 221/259

(Continued)

*Primary Examiner* — Timothy R Waggoner

(74) *Attorney, Agent, or Firm* — Cooper Legal Group, LLC

(57) ABSTRACT

One or more techniques and/or systems are provided for dispense event verification. For example, a user verification component may be associated with a dispenser that is configured to dispense material, such as a sanitizer dispenser configured to dispense sanitizer. The user verification component may obtain user identification information associated with a user attempting to invoke the dispenser to perform a dispense event of material. The user identification information may be evaluated against a dispense access model (e.g., specifying levels of access to the dispenser for users, such as a first user being allowed to perform up to 10 dispense events of sanitizer every 45 minutes) to determine whether to facilitate or restrict the dispense event. In this way, dispensing of material that may be susceptible to abuse by users (e.g., prisoners, psychiatric ward patients, daycare children, etc.) may be monitored and/or restricted for the safety of such users.

20 Claims, 11 Drawing Sheets

(56) References Cited

U.S. PATENT DOCUMENTS

| | | | | |
|---|---|---|---|---|
| 7,756,604 | B1 * | 7/2010 | Davis | G06Q 20/342 700/236 |
| 2003/0117281 | A1 * | 6/2003 | Sriharto | G08B 13/1427 340/568.1 |
| 2004/0133705 | A1 * | 7/2004 | Broussard | G06F 19/3462 710/1 |
| 2007/0260491 | A1 * | 11/2007 | Palmer | G06F 19/3418 705/3 |
| 2009/0051545 | A1 * | 2/2009 | Koblasz | G08B 21/245 340/573.1 |
| 2010/0097224 | A1 * | 4/2010 | Prodanovich | B08B 3/04 340/572.1 |
| 2012/0130534 | A1 * | 5/2012 | Wurm | G06Q 20/203 700/236 |
| 2012/0209243 | A1 * | 8/2012 | Yan | A61M 5/008 604/500 |
| 2013/0175291 | A1 * | 7/2013 | Wegelin | A47K 5/1217 222/23 |
| 2014/0228783 | A1 * | 8/2014 | Kraft | A61F 9/0008 604/300 |
| 2014/0277709 | A1 * | 9/2014 | Olson | G07F 17/0092 700/241 |
| 2015/0259110 | A1 * | 9/2015 | Blackburn | B65D 50/00 222/1 |
| 2016/0078264 | A1 * | 3/2016 | Armstrong | G08B 13/2417 340/572.1 |
| 2016/0325957 | A1 * | 11/2016 | Borke | G05B 15/02 |
| 2017/0076063 | A1 * | 3/2017 | Louie | G06F 19/3456 |

* cited by examiner

DISPENSE EVENT VERIFICATION FOR DISPENSERS

CROSS-REFERENCE TO RELATED APPLICATIONS

This application claims priority to U.S. Provisional Patent Application No. 62/091,127, filed on Dec. 12, 2014, the entire disclosure of which is hereby incorporated by reference.

TECHNICAL FIELD

The instant application is generally directed towards systems and techniques for dispense event verification. In particular, a user verification component may utilize a dispense access model to determine whether a user is allowed to invoke a dispenser to perform a dispense event of a material (e.g., a soap dispenser dispensing soap, a medicine cabinet providing access to medicine, etc.).

BACKGROUND

Many locations, such as hospitals, psychiatric wards, elder care facilities, prisons, etc., may deploy dispensers for material distribution. In an example, a soap dispenser may be used for sanitization (e.g., a user may invoke the soap dispenser to dispense soap for sanitization). In another example, a medicine cabinet may comprise various medicines that may be available for retrieval by healthcare personnel. Unfortunately, such dispensers may be susceptible to abuse and/or tampering. In an example, a person may attempt to ingest sanitizer at toxic levels, which may result in bodily harm or death. In another example, a person may attempt to utilize a dispenser as a weapon or in conjunction with rope or other material for choking/suffocation purposes.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

Among other things, one or more systems and/or techniques for dispense event verification are provided herein. An access model definition component may define rules that specify levels of access to a dispenser for users (e.g., a first user, such as a nurse, may be allowed to invoke a soap dispenser to dispense soap 45 times per hour; a second user, such as a patient, may be allowed to invoke the soap dispense to dispense soap 5 times per hour with 2 minute gaps between dispenses; etc.). The access model definition component may generate a dispense access model based upon the rules (e.g., a data structure, such as one or more database tables, a log, a file, etc., within which rules are defined and/or current dispenser utilization by users are stored). The dispense access model may be updated with new rules and scenarios, rule modifications, and/or new users.

A user verification component may be associated with the dispenser (e.g., comprised within the dispenser or comprised remote to the dispenser such as within a server that is communicatively coupled to the dispenser such as by an Ethernet connection or any other communication connection). The user verification component may be configured to obtain user identification information associated with a user attempting to invoke the dispenser to perform a dispense event of material. The user identification information may be obtained as a fingerprint by a fingerprint reader, a voice identification by a microphone, a user ID from an RFID signal associated with a user ID badge, an image obtained by a camera, a security code, and/or any other form of identification such as an audible identification, an image-based identification, etc.

The user verification component may evaluate the user identification information against the dispense access model (e.g., against a rule defined for the user and/or current dispenser utilization by the user). Responsive to the dispense access model indicating that the user is allowed to invoke the dispense event, the dispense event may be facilitated (e.g., the user may have one or more allotted dispense events available to use). Responsive to the dispense access model indicating that the user is not allowed to invoke the dispense event (e.g., the user may have used up an allotted number of dispense events allocated to the user), the dispense event may be restricted, which may prevent abuse such as over-consumption of material from the dispenser.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DETAILED DESCRIPTION

Figure 1:
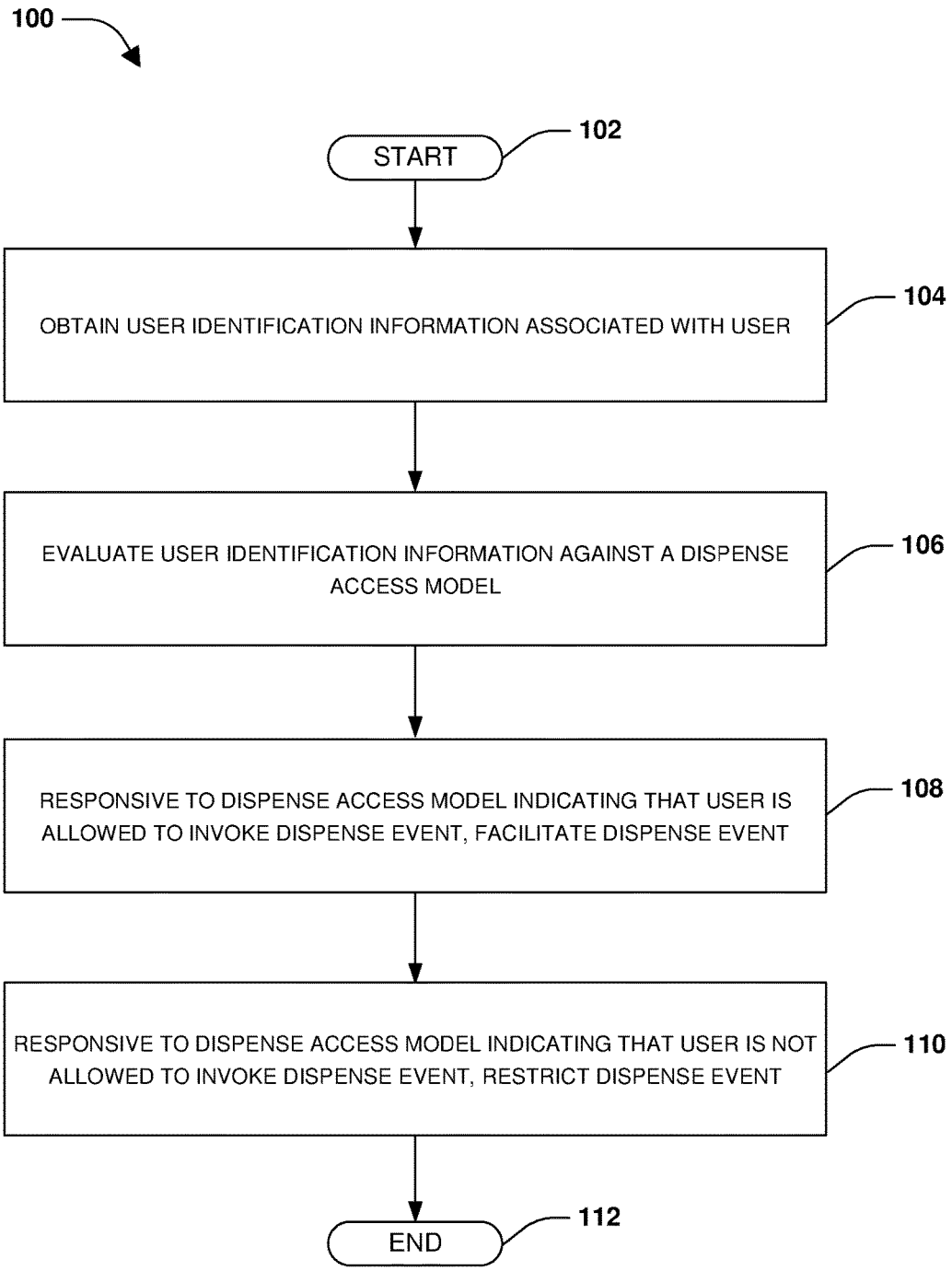
FIG. 1 is a flow diagram illustrating an example method of dispense event verification.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It may be evident, however, that the claimed subject matter may be practiced without these specific details. In other instances, structures and devices are illustrated in block diagram form in order to facilitate describing the claimed subject matter.

An embodiment of dispense event verification is illustrated by an exemplary method 100 of FIG. 1. At 102, the method starts. A dispenser may be configured to dispense a material, such as soap, liquid, powder, foam, sanitizer, medicine, food, and/or any other objects or material. In an example, a soap dispenser may be configured to dispense a soap material into a user's hand. In another example, a medicine dispenser may be configured to provide a user with access inside an enclosure for medicine retrieval (e.g., a cabinet door may unlock and/or open). The dispenser may be configured according to an anti-ligature configuration that may mitigate the ability of a user to use the dispenser to create tension in a rope, string, blanket, clothing, or other material that could be used for self-harm such as suffocation or choking. For example, the dispenser may comprise a top surface that comprises a first slope to a first side of the dispenser, a second slope to a second side of the dispenser, a third slope to a front side of the dispenser (e.g., the rope may slip off the top surface of the dispenser), and/or any other sloped surfaces such as a curved surface sloping away from a wall to which the dispenser is attached. In an example, the dispenser may comprise a lock and/or a metal enclosure that contains the material, which may provide improved strength and resistance against forceful tampering to obtain the material therein. In an example, the dispenser may be configured according to a flush wall mount configuration where the dispenser is recessed into a wall, which may mitigate forced attempts to remove the dispenser from the wall. The dispenser may be configured with communication capabilities, such as wireless communication (e.g., a Bluetooth or other wireless protocol used to connect to a mobile device) and/or wired communication (e.g., an Ethernet connection to a hospital administration server).

A dispense access model may be defined for use by the dispenser in order to determine whether a user is allowed to invoke a dispense event of material from the dispenser. Different rules may be specified for different users and/or anonymous/unidentified users (e.g., a prisoner, a prison guard, a nurse, a doctor, a psychiatric ward nurse, a psychiatric patient, an elder nursing home patient, a child care provider, a daycare child, and/or other users may have different levels of access to the dispenser). In an example, a user may utilize a dispenser security user interface to define rules for users. For example, a computing device may provide the user with access to the dispenser security user interface (e.g., an application, a mobile app, a website, etc.). The dispenser security user interface may comprise rule creation, deletion, and/or modification functionality. For example, a rule creation interface may comprise a user identification entry field into which the user may specify user identification information of a new user for which a new rule is to be created. A rule template interface may specify a rule template "allow X number of dispense events every Y seconds" such that the user may specify values for a variable X (e.g., a number of allowed dispense events) and for a variable Y (e.g., a timespan during which the user is allocated the number of dispense events, and upon expiration of the timespan the allocated number is reset/refreshed).

In an example, a first rule, specifying a first level of access for a first user, may be defined (e.g., a prison guard may be allowed to dispense material up to a first dispense limit within a first timespan, such as up to 40 dispenses within an hour). A second rule, specifying a second level of access for a second user, may be defined (e.g., a prisoner may be allowed to dispense material up to a second dispense limit within a second timespan, such as up to 6 dispenses within an hour with at least 5 minutes between dispenses). In an example, a rule may be defined for anonymous users (e.g., unrecognized/unidentified users). The rule may specify that an anonymous user may be restricted from utilizing the dispenser for a timeout timespan (e.g., the user may be blocked for 15 minutes from using the dispenser) responsive to the anonymous user attempting to perform a threshold number of dispense events within a timespan (e.g., more than 8 attempts within 20 seconds, which may be indicative of abuse such as a prisoner attempting to ingest an alcohol based sanitizer). The first rule, the second rule, and/or any other rules may be included within the dispense access model. In an example, an emergency override scheme may be defined for the dispenser (e.g., a code used for unlimited access to material and/or to turn off dispense event verification).

The dispense access model may be updated to accommodate new users, to remove old users, to modify levels of access for users, to define new types of rules, etc. In an example, the dispenser may establish a communication connection with a computing device (e.g., establish a Bluetooth connection with a mobile device comprising a dispenser security interface). An access model update may be received over the communication connection from the computing device. The dispense access model may be updated based upon the access model update.

At 104, user identification information, associated with a user attempting to invoke the dispenser to perform a dispense event of material, may be obtained (e.g., a motion sensor may detect a presence of the user; an RFID detector may detect an RFID signal from an object such as an ID badge of the user; the user may place a hand under an actuation sensor of the dispenser, etc.). For example, the dispenser may comprise one or more sensors (e.g., an eye scanner, an RFID reader used to obtain a user ID provided by a badge worn by the user, a camera, a fingerprint reader, a code entry device, etc.) used to obtain the user identification information. At 106, the user identification information may be evaluated against the dispense access model (e.g., against a rule defined for the user and/or current dispenser utilization by the user). For example, the dispense access model may comprise a data structure, such as a lookup table, that may be indexed and/or queried by user identification information of users for which rules are specified (e.g., the data structure may comprise one or more database tables comprising rules for users such that the user identification information may be used to query the one or more database tables to identify a rule for the user).

At 108, responsive to the dispense access model indicating that the user is allowed to invoke the dispense event, the dispense event may be facilitated. In an example, a soap dispenser may dispense soap into the user's hand. In another example where the dispenser comprises an enclosure housing the material (e.g., a medicine cabinet), the user may be provided with access inside the enclosure for material retrieval. An alert may be provided if an access time limit is exceeded (e.g., the user may be given 30 seconds to retrieve the material) and/or if the user attempts to remove a restricted material, to which the user does not have permission to access, from the enclosure (e.g., the prison warden may be given permission to access medicine for prisoners directly under the prison warden's care, but not medicine of other prisoners). The attempted removal may be detected by a camera, an RFID tracking system, and/or any other detection functionality. At 110, responsive to the dispense access model indicating that the user is not allowed to invoke the dispense event, the dispense event may be restricted such that the dispenser does not dispense material. For example, the user may have exceeded a number of allocated dispenses. In an example, a notification or explanation may be provided to the user (e.g., an audible message, a visual message on a screen, a blinking light, etc.).

In an example, a visible notification (e.g., a visual message on a screen, a blinking light, etc.), an audible notification, an alarm trigger, or a lockout state for the dispense (e.g., the dispenser may block further user access) may be performed based upon at least one of attempted abuse of the dispenser (e.g., a threshold number of unsuccessful dispense events within a relatively short time span; attempted physical tampering; etc.), an unlocked status of the dispenser for a threshold timespan (e.g., a user may have accidently left the dispenser unlocked after replacing a material refill container within the dispenser), or an actuation of the dispenser (e.g., a chime to indicate a dispense event occurred). For example, usage of the dispenser within a timespan may be evaluated to create a usage metric (e.g., a number of attempted dispense events within a 2 minute timespan). Responsive to the usage metric being indicative of attempted abuse (e.g., more than 10 attempts within the 2 minute timespan), the dispense event may be restricted and/or an alert may be provided. In an example, a user access metric may be generated for the user based upon interaction of the user with the dispenser. The user access metric may be provided through a dispenser security interface (e.g., displayed through an interface provided by a prison administration computing device).

In an example, the dispenser may establish a communication connection with a computing device (e.g., a mobile device of a prison administrator). Usage metrics, such as dispense event statistics, detected abuse, and/or an amount of remaining material within a refill container of the dispenser, may be provided over the communication connection to the computing device. In this way, dispense events may be verified and/or tracked. At 112, the method ends.

Figure 2:
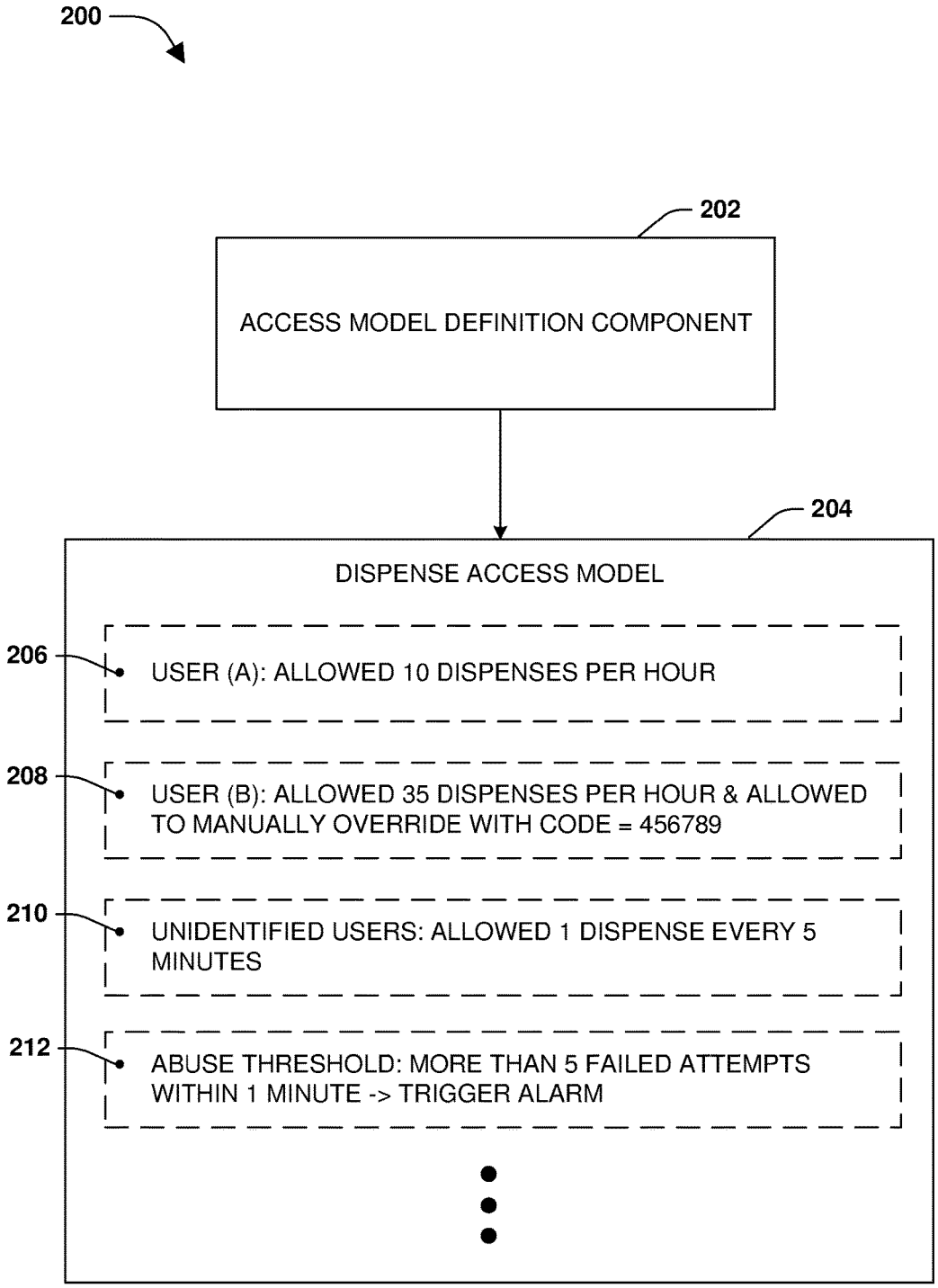
FIG. 2 is a component block diagram illustrating an example system for dispense event verification, where a dispense access model is generated.

FIG. 2 illustrates an example of a system 200, comprising an access model definition component 202, for dispense event verification. The access model definition component 202 may be configured to generate a dispense access model 204 that may be utilized by one or more dispensers for dispense event verification. The access model definition component 202 may define various rules for users, anonymous users, and/or scenarios (e.g., an abuse scenario, an emergency scenario, etc.). For example, the access model definition component 202 may define a first rule 206 that a user (A) is allowed up to 10 dispenses per hour (e.g., per dispenser; per a set of dispensers that communicate and share usage metrics of users for collaborative dispense event verification and collaborative implementation of the dispense access model 204; etc.). The access model definition component 202 may define a second rule 208 that a user (B) is allowed 35 dispenses per hour and is allowed to manually override the rule for unlimited access by using a code 456789. The access model definition component 202 may define a third rule 210 that unidentified users, such as an anonymous user, may be allowed 1 dispense every 5 minutes (e.g., 1 anonymous dispense event may be allowed every 5 minutes since anonymous users may be indistinguishable from one another). The access model definition component 202 may define a fourth rule 212 specifying that an alarm is to be triggered based upon an occurrence of more than 5 failed attempts within 1 minute.

The access model definition component 202 may define other rules, not illustrated, such as a first time period rule specifying a first level of access for the dispenser (e.g., during non-visiting hours, the dispenser may allow 1 anonymous dispense event every 5 minutes) and a second time period rule specifying a second level of access for the dispenser (e.g., during peak visiting hours, the dispenser may allow 20 anonymous dispense events every 5 minutes with 10 seconds between dispense events). In this way, varying levels of access may be provided to the dispenser at different times (e.g., visiting hours) and/or dates (e.g., a holiday). In this way, the dispense access model 204 may be generated.

Figure 3:
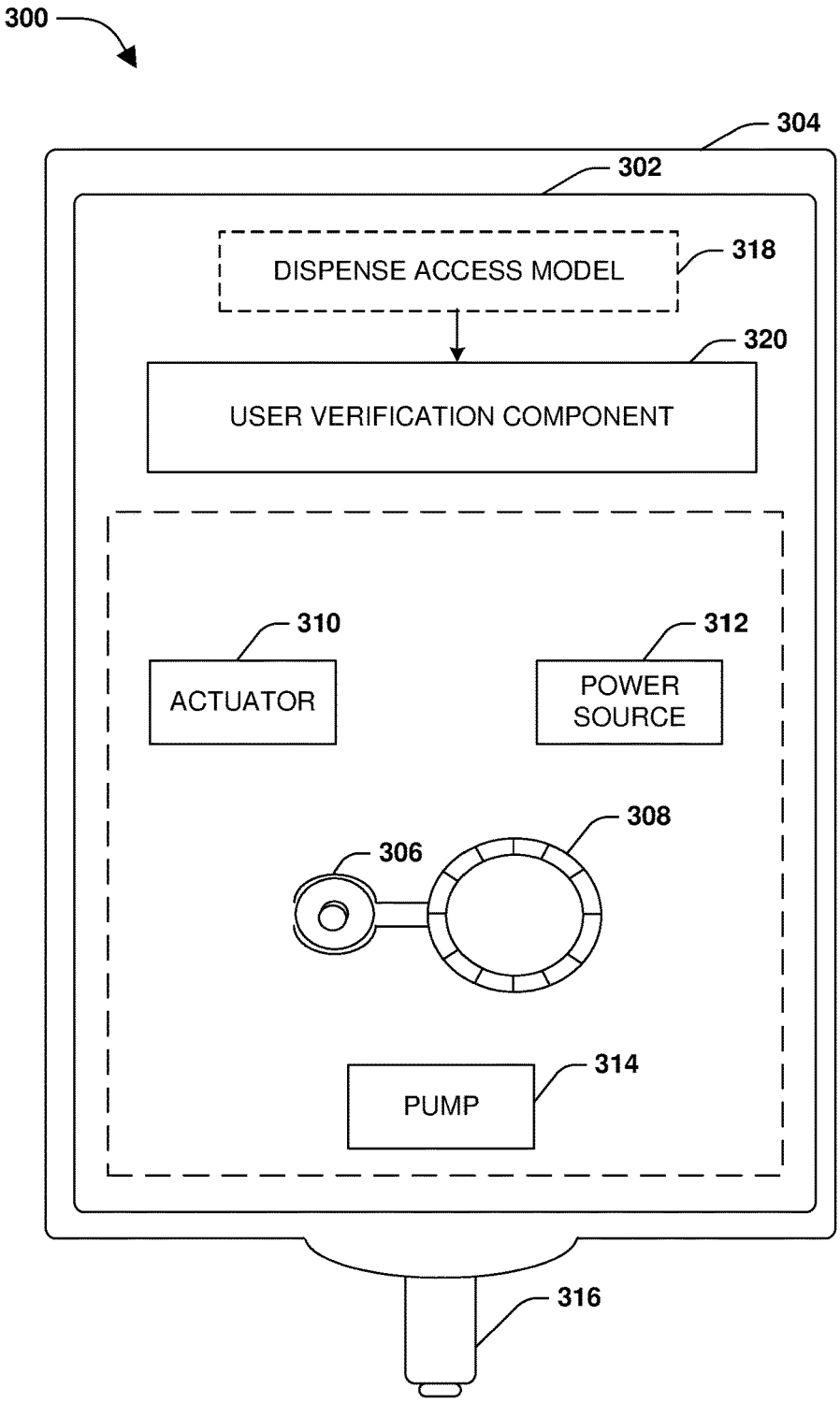
FIG. 3 is a component block diagram illustrating an example system for dispense event verification.

FIG. 3 illustrates an example of a system 300, comprising a user verification component 320, for dispense event verification. The user verification component 320 may be associated with a dispenser 304 (e.g., integrated into the dispenser 304 or located at a remote location such as a server that is communicatively coupled to the dispenser 304). The dispenser 304 may comprise a housing 302 configured to hold a refill container comprising a material (e.g., a liquid material, a powder material, an aerosol material, an antibacterial product, medicine, etc.). The housing 302 may comprise various mechanical and/or electrical components that facilitate operation of the dispenser 304, such as one or more components that dispense material from the refill container. In an example, the housing 302 may comprise an actuator 310, a power source 312, a motor 306, a drivetrain 308 (e.g., a gear train), and/or other components (e.g., a pump 314 and/or a dispenser nozzle 316 associated with the refill container). The power source 312 (e.g., a battery, an AC adapter, power from a powered network communication line, etc.) may provide power to the actuator 310, the motor 306, and/or other components. The actuator 310 may be configured to detect a dispense request (e.g., a user may place a hand in front of an actuation sensor; the user may press an actuation button or lever; etc.). The actuator 310 may be configured to invoke the motor 306 to operate the drivetrain 308 so that the pump 314 dispenses material from the refill container 302 through the dispenser nozzle 316.

When a user attempts to utilize the dispenser 304 (e.g., the user comes within a threshold distance of the dispenser 304), the user verification component 320 may obtain user identification information associated with the user. The user verification component 320 may evaluate the user identification information against a dispense access model 318 (e.g., dispense access model 204 of FIG. 2) to determine whether to facilitate a dispense event or restrict the dispense event of material from the dispenser 304.

Figure 4:
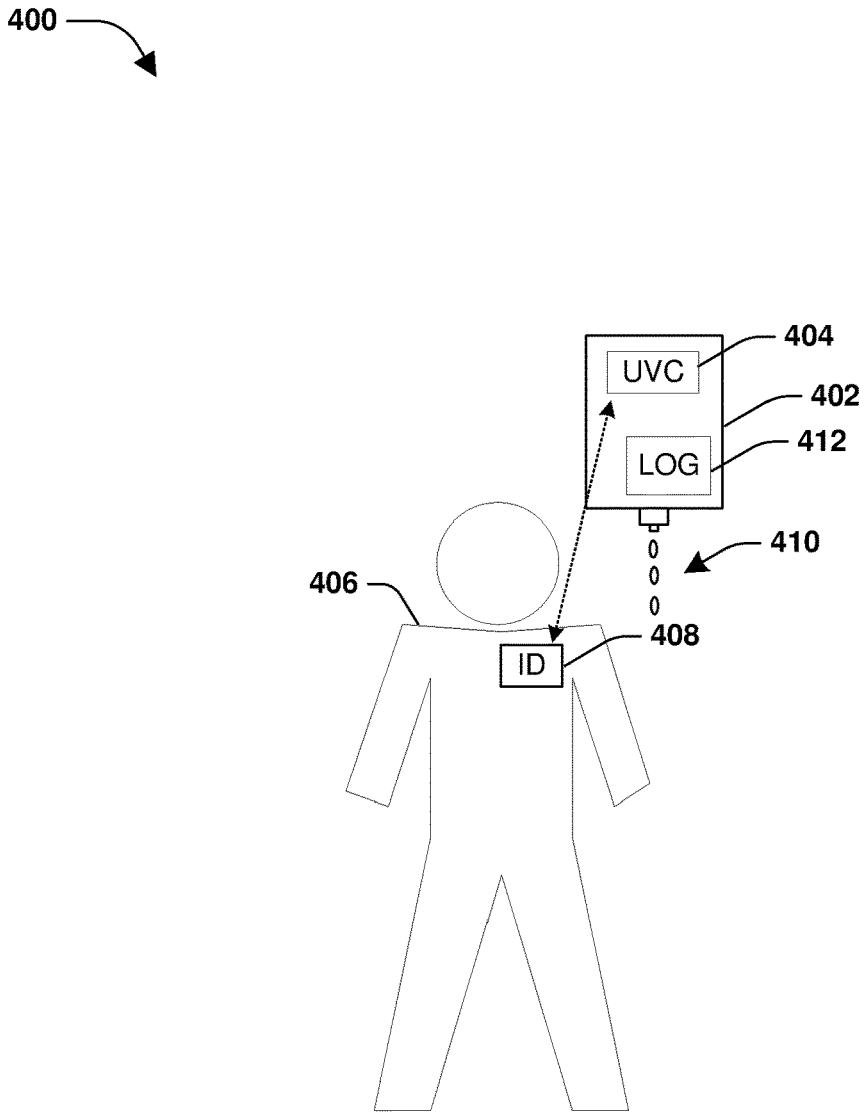
FIG. 4 is a component block diagram illustrating an example system for dispense event verification, where a dispense event is facilitated.

FIG. 4 illustrates an example of a system 400, comprising a user verification component 404, for dispense event verification. The user verification component 404 may be associated with a dispenser 402. The user verification component 404 may obtain user identification information associated with a user 406 attempting to invoke the dispenser 402 to perform a dispense event 410 of material. For example, the user verification component 404 may utilize RFID functionality to detect the user identification information from a badge 408 worn by the user 406. The user verification component 404 may facilitate the dispense event 410 based upon a dispense access model indicating that the user 406 is allowed to invoke the dispense event 410. In an example, the user verification component 404 may generate a user access metric based upon the occurrence of the dispense event 410 (e.g., the user access metric may indicate that 9 out of 10 allowed dispense events have occurred), which may be stored within a log 412 (e.g., the log 412 may be stored locally on the dispenser 402 and/or may be stored or replicated to a remote location such as a server hosting a dispenser security interface). In an example, the log 412 may be incorporated into the dispense access model (e.g., the dispense access model may comprise a data structure, such as one or more database tables, within which rules are defined for users and/or current dispenser utilization by users are stored) so that the user verification component 404 may consult the dispense access model, and thus information from the log 412, to determine current dispenser utilization by the user 406.

Figure 5A:
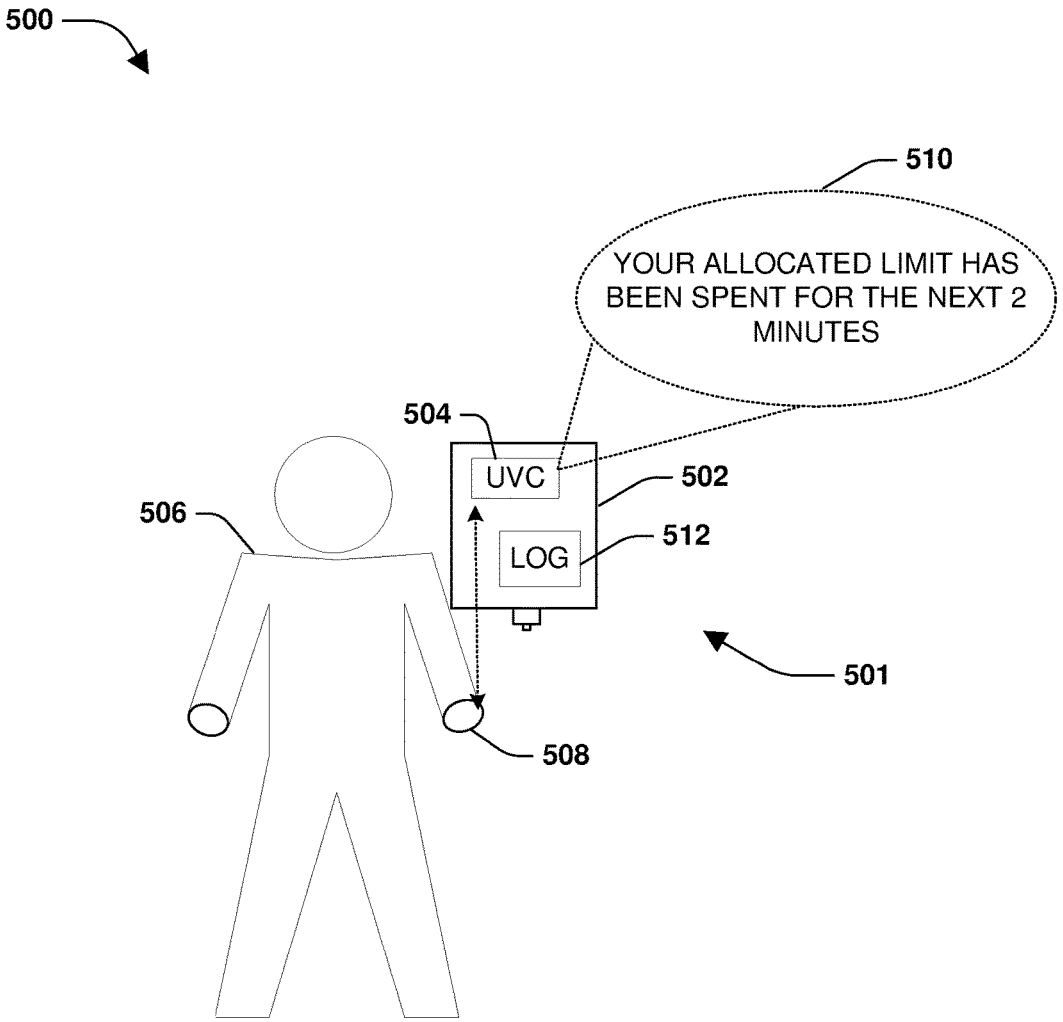
FIG. 5A is a component block diagram illustrating an example system for dispense event verification, where a dispense event is restricted.
Figure 5B:
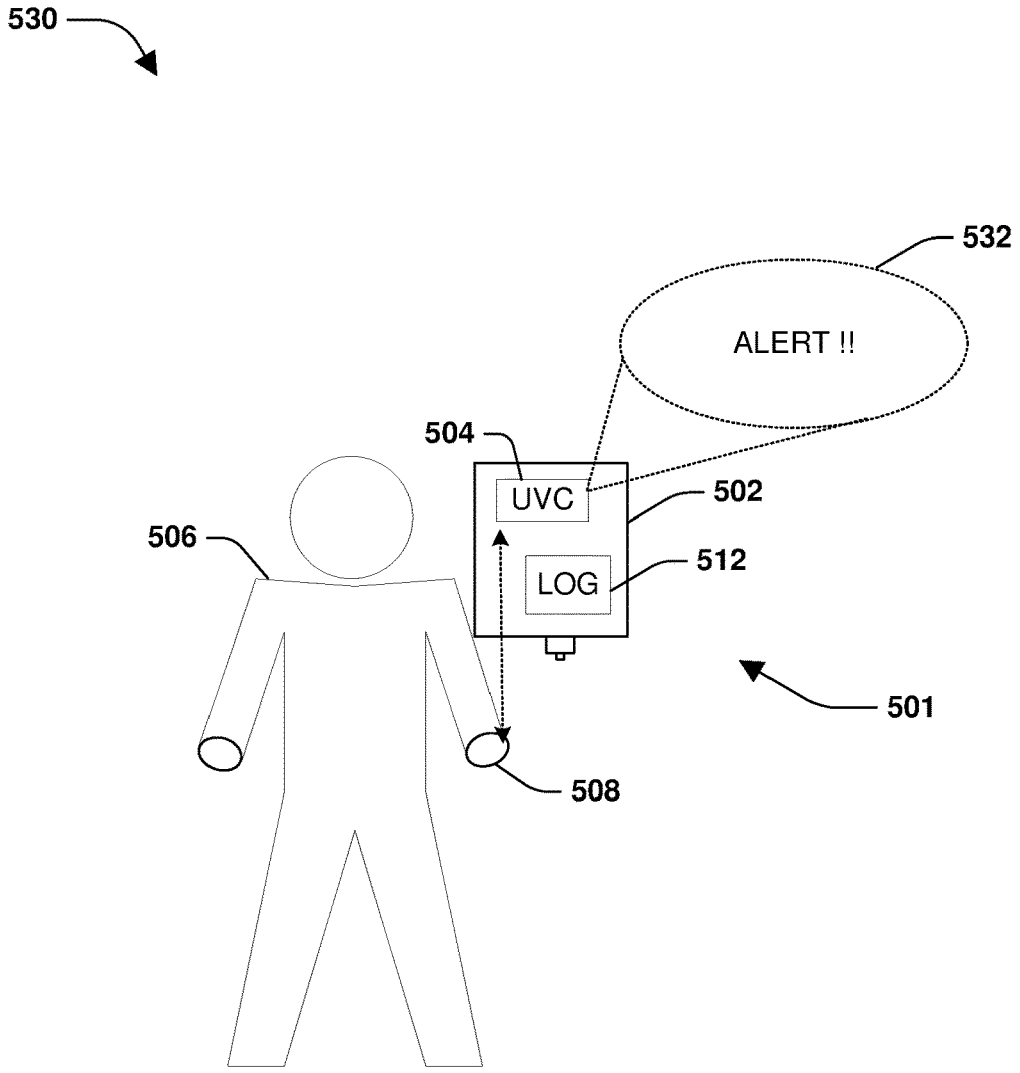
FIG. 5B is a component block diagram illustrating an example system for dispense event verification, where an alert is provided.

FIGS. 5A-5B illustrate examples of a system 501, comprising a user verification component 504, for dispense event verification. FIG. 5A illustrates an example 500 of the user verification component 504 being associated with a dispenser 502. The user verification component 504 may obtain user identification information associated with a user 506 attempting to invoke the dispenser 502 to perform a dispense event of material. For example, the user verification component 504 may utilize fingerprint recognition functionality to obtain a fingerprint from a hand 508 of the user 506 as the user identification information. The user verification component 504 may evaluate the user identification information against a dispense access model, which may indicate that the user 506 has no dispense events available for the next 2 minutes (e.g., the user 506 have may reached a dispense event limit). Accordingly, the user verification component 504 may restrict the dispense event such that the dispenser 502 does not dispense material to the user 506. In an example, the user verification component 504 may provide a notification 510 that the user 506 has used up an amount of dispense events allocated to the user 506 for the next 2 minutes. The user verification component 504 may generate a user access metric based upon the failed dispense event attempt (e.g., the user access metric may indicate that the user has attempted a dispense event after having used up the allocated amount of dispense events), which may be stored within a log 512.

FIG. 5B illustrates an example 530 of the user verification component 504 detecting attempted abuse of the dispenser 502. For example, the user 506 may have attempted a threshold number of dispense events within a timespan (e.g., 5 or more dispense event attempts within a 1 minute timespan) and/or the user 506 may attempt to physically manipulate the dispenser 502 (e.g., break open the dispenser 502 or remove the dispenser 502 from a wall). The user verification component 504 may provide an alert 532 based upon the detected attempted abuse (e.g., an audible alert, a visual alert, the dispenser 502 may be restricted from dispensing material until reset or a lockout time period expires, the alert 532 may be sent over a communication connection to a computing device such as for display through a dispenser security interface). The user verification component 504 may generate a second user access metric based upon the alert 532, which may be stored within the log 512.

Figure 6:
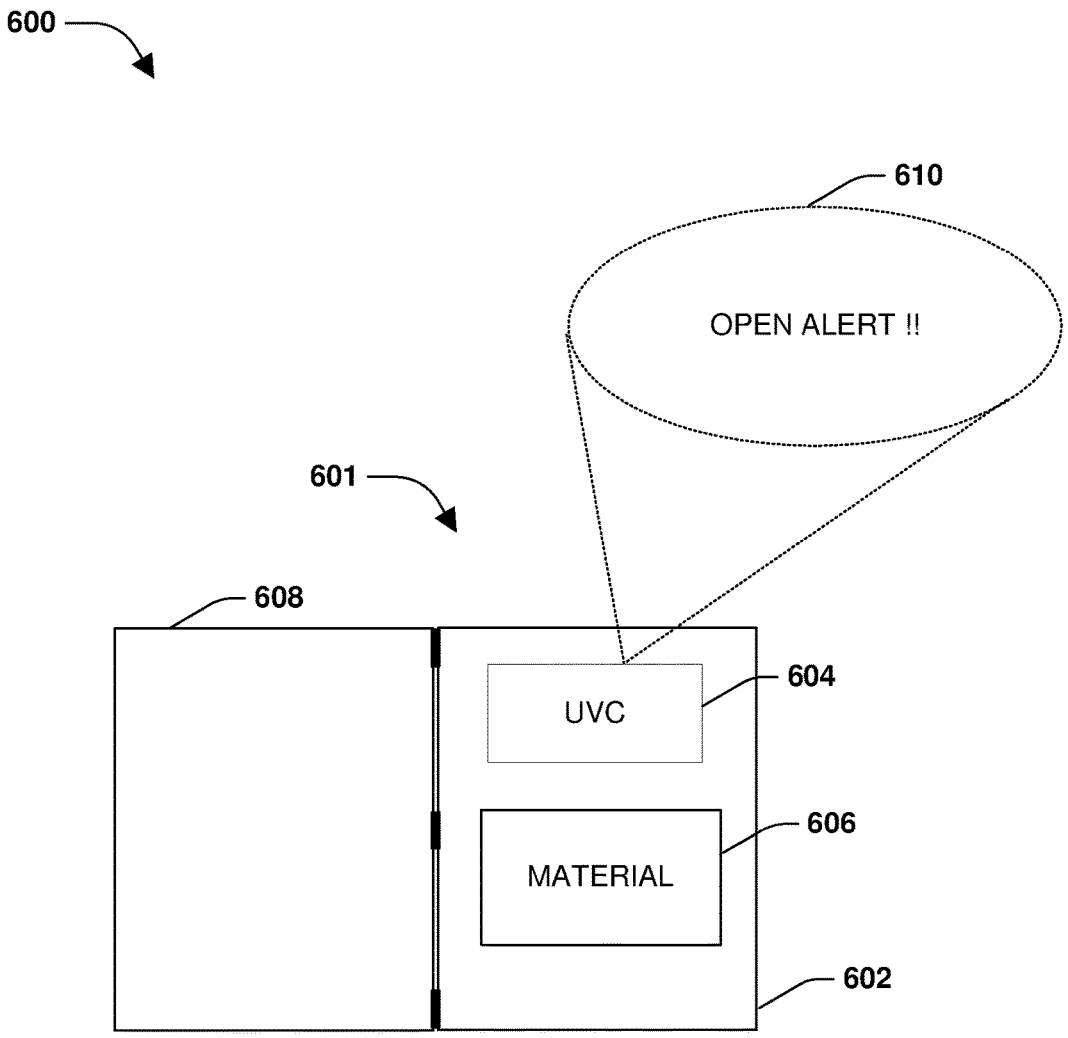
FIG. 6 is a component block diagram illustrating an example system for dispense event verification, where an alert is provided.

FIG. 6 illustrates an example of a system 600, comprising a user verification component 604, for dispense event verification. The user verification component 604 may be associated with a dispenser 601 comprising material 606, such as a medicine cabinet comprising medicine. The dispenser 601 may comprise an enclosure 602 that houses the material 606. The enclosure 602 may comprise a door 608 (e.g., a locking door to prevent unauthorized access to the material 606) through which a user may access the material 606 when open. The user verification component 604 may provide a user with access inside the enclosure 602 for material removal based upon a dispenser access model indicating that the user is allowed to invoke a dispense event by the dispenser 601. In an example, the user verification component 604 may provide an alert 610 based upon an access time limit being exceeded by the user (e.g., the user may have accidently left the door 608 open for more than 40 seconds).

Figure 7:
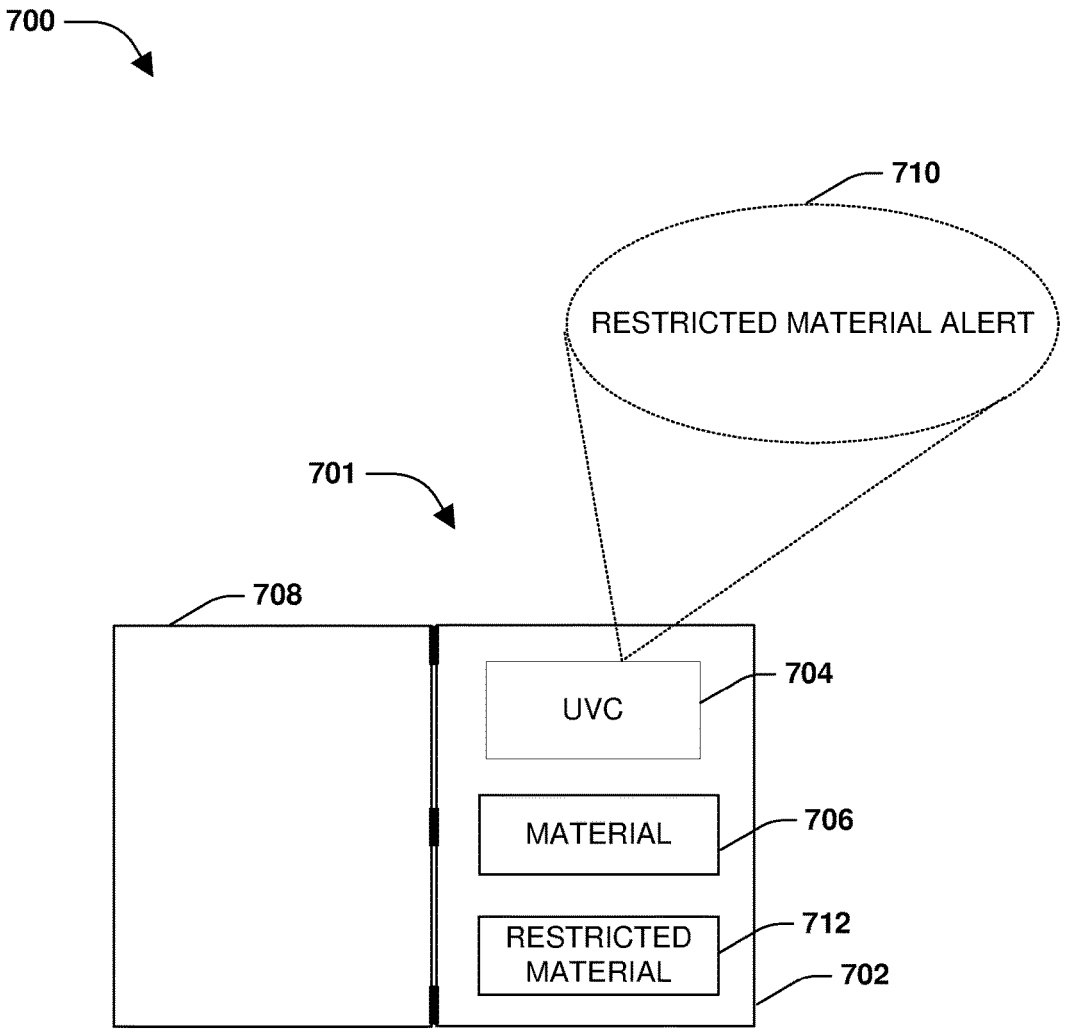
FIG. 7 is a component block diagram illustrating an example system for dispense event verification, where an alert is provided.
Figure 8:
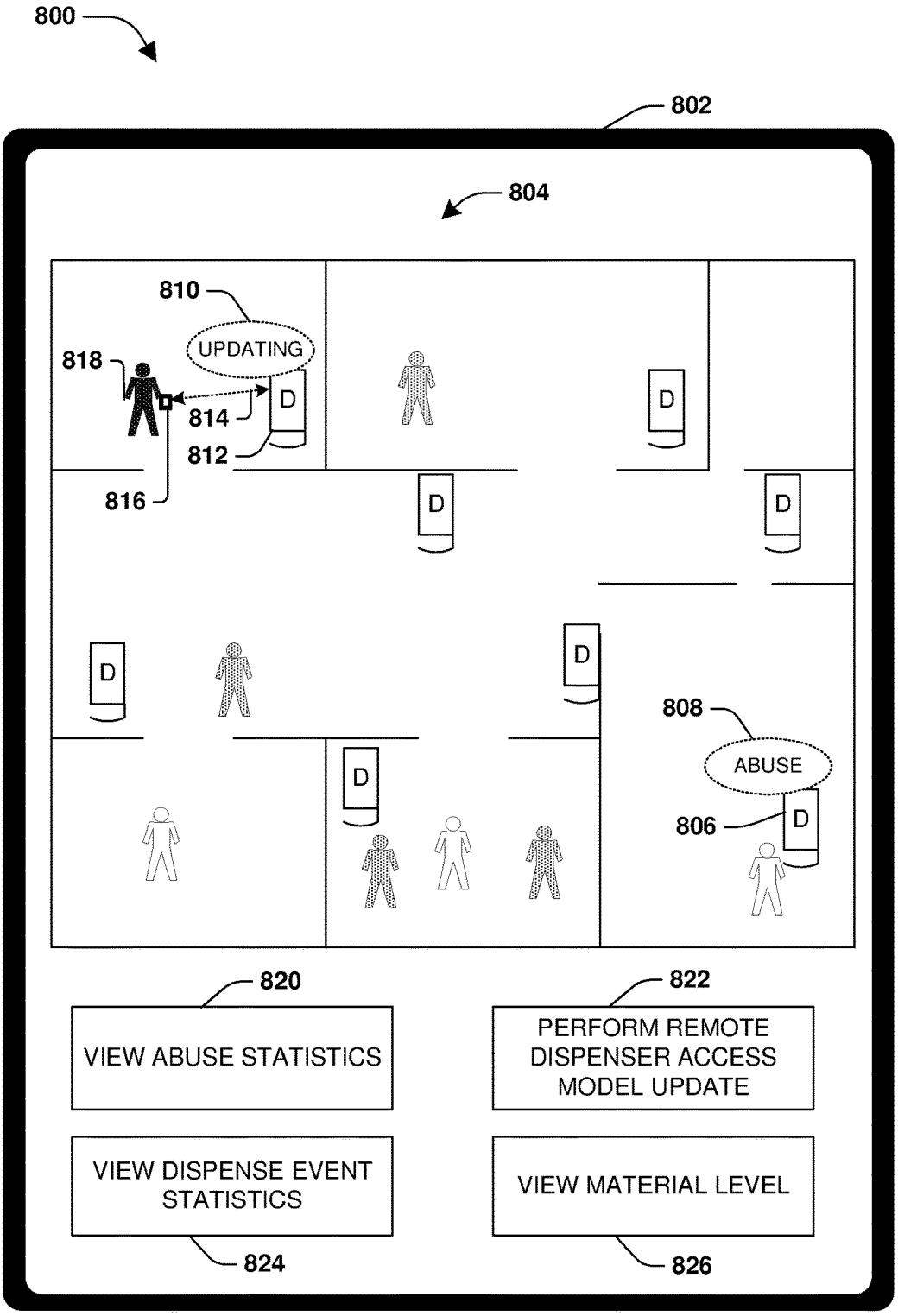
FIG. 8 is an illustration of an example of a dispenser security interface.

FIG. 7 illustrates an example of a system 700, comprising a user verification component 704, for dispense event verification. The user verification component 704 may be associated with a dispenser 701 comprising material 706 and/or restricted material 712, such as a medicine cabinet comprising medicine. The dispenser 701 may comprise an enclosure 702 that houses the material 706 and/or the restricted material 712. The enclosure 702 may comprise a door 708 (e.g., a locking door to prevent unauthorized access to the material 706) through which a user may access the material 706 when open. The user verification component 704 may provide a user with access inside the enclosure 702 for removal of the material 706 to which the user has authorization to access (e.g., as specified by a dispense access model), but not for removal of the restricted material 712 to which the user does not have authorization to access (e.g., as specified by the dispense access model). In an example, the user verification component 704 may provide an alert 710 based upon the user attempting to access or remove the restricted material 712 (e.g., a camera, RFID functionality, motion sensing functionality, and/or other functionality may be used to track the restricted material 712).

Figure 9:
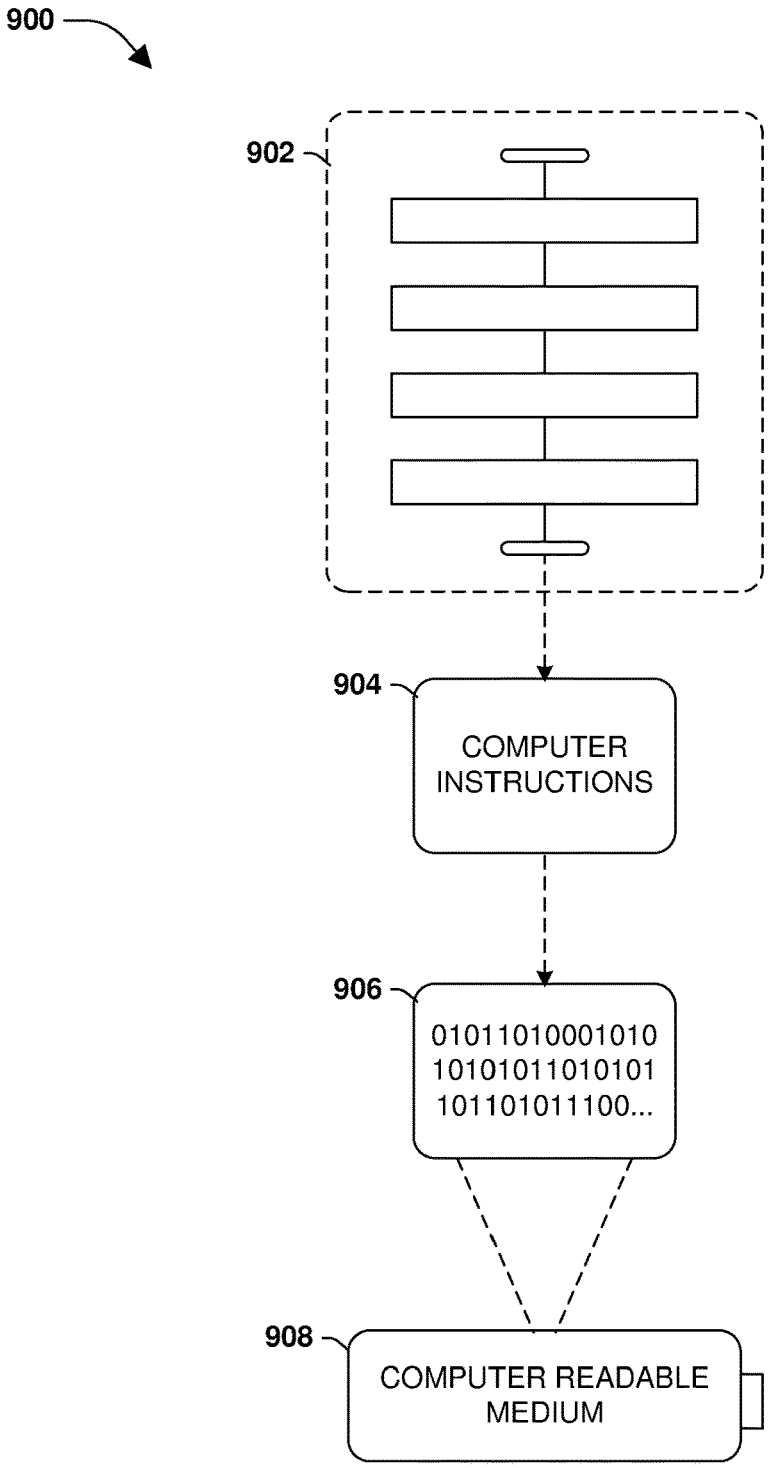
FIG. 9 is an illustration of an example computer readable medium wherein processor-executable instructions configured to embody one or more of the provisions set forth herein may be comprised.

FIG. 9 illustrates an example 900 of a dispenser security interface 904 provided through a computing device 802 (e.g., a mobile device, a tablet, a personal computer, a wearable device, etc.). The dispenser security interface 804 may be populated with information, such as user access metrics, provided by user verification components associated with dispensers. For example, the dispenser security interface 804 may be populated with a map of a psychiatric ward comprising one or more dispenser, such as a first dispenser 806, a second dispenser 812, and/or other dispensers. The map may illustrate the dispensers and/or various events occurring with the dispensers. For example, the map may provide an alert 808 that a first user may be attempting to abuse the first dispenser 806. The map may provide an update notification 810 that a second user 818 is utilizing a mobile device 816 to update, over a communication connection 814, a dispense access model used by a user verification component for dispense event verification of the second dispenser 812.

The dispenser security interface 804 may be populated with a view abuse statistics interface 820 through which a user may view dispense abuse statistics of dispensers within the psychiatric ward (e.g., users attempting to remove or break a dispenser; a user attempting to perform a threshold number of dispense events within a relatively short timespan; etc.). The dispenser security interface 804 may be populated with a view dispense event statistics 824 through which the user may view information regarding successful and/or restricted dispense events. The dispenser security interface 804 may be populated with a view material level interface 826 through which the user may determine an amount of remaining material within a dispenser. The dispenser security interface 804 may be populated with a perform remote dispenser access model update interface 822 through which the user may remotely update a dispense access model used by a user verification component for dispense event verification of a dispenser.

Still another embodiment involves a computer-readable medium comprising processor-executable instructions configured to implement one or more of the techniques presented herein. An example embodiment of a computer-readable medium or a computer-readable device is illustrated in FIG. 9, wherein the implementation 900 comprises a computer-readable medium 908, such as a CD-R DVD-R, flash drive, a platter of a hard disk drive, etc., on which is encoded computer-readable data 906. This computer-readable data 906, such as binary data comprising at least one of a zero or a one, in turn comprises a set of computer instructions 904 configured to operate according to one or more of the principles set forth herein. In some embodiments, the processor-executable computer instructions 904 are configured to perform a method 902, such as at least some of the exemplary method 90 of FIG. 1, for example. In some embodiments, the processor-executable instructions 904 are configured to implement a system, such as at least some of the exemplary system 200 of FIG. 2, at least some of the exemplary system 300 of FIG. 3, at least some of the exemplary system 400 of FIG. 4, at least some of the exemplary system 501 of FIGS. 5A-5B, at least some of the exemplary system 600 of FIG. 6, and/or at least some of the exemplary system 700 of FIG. 7, for example. Many such computer-readable media are devised by those of ordinary skill in the art that are configured to operate in accordance with the techniques presented herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing at least some of the claims.

As used in this application, the terms "component," "module," "system", "interface", and/or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, many modifications may be made to this configuration without departing from the scope or spirit of the claimed subject matter.

Figure 10:
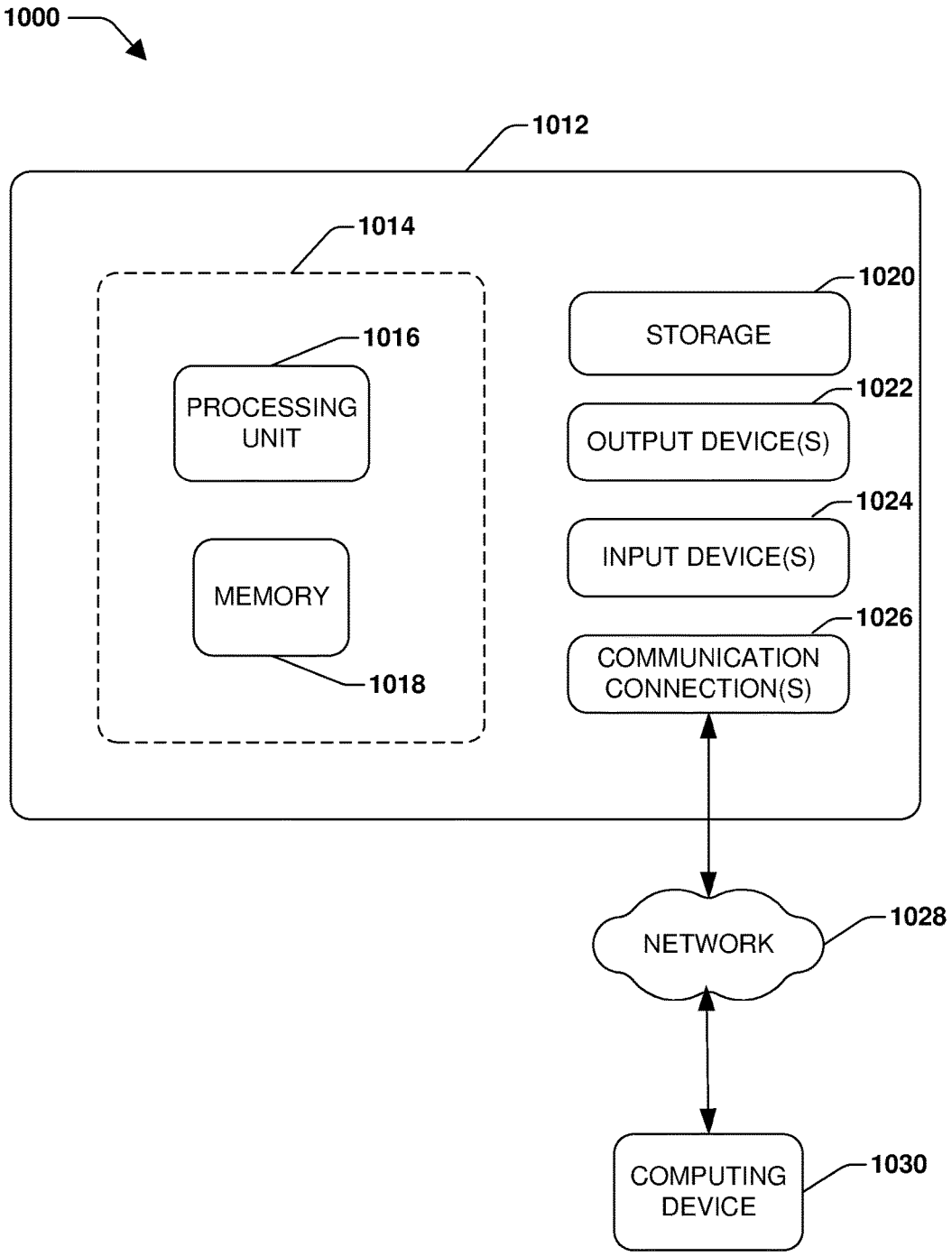
FIG. 10 illustrates an example computing environment wherein one or more of the provisions set forth herein may be implemented.

FIG. 10 and the following discussion provide a brief, general description of a suitable computing environment to implement embodiments of one or more of the provisions set forth herein. The operating environment of FIG. 10 is only one example of a suitable operating environment and is not intended to suggest any limitation as to the scope of use or functionality of the operating environment. Example computing devices include, but are not limited to, personal computers, server computers, hand-held or laptop devices, mobile devices (such as mobile phones, Personal Digital Assistants (PDAs), media players, and the like), multiprocessor systems, consumer electronics, mini computers, mainframe computers, distributed computing environments that include any of the above systems or devices, and the like.

Although not required, embodiments are described in the general context of "computer readable instructions" being executed by one or more computing devices. Computer readable instructions may be distributed via computer readable media (discussed below). Computer readable instructions may be implemented as program modules, such as functions, objects, Application Programming Interfaces (APIs), data structures, and the like, that perform particular tasks or implement particular abstract data types. Typically, the functionality of the computer readable instructions may be combined or distributed as desired in various environments.

FIG. 10 illustrates an example of a system 1000 comprising a computing device 1012 configured to implement one or more embodiments provided herein. In one configuration, computing device 1012 includes at least one processing unit 1016 and memory 1018. Depending on the exact configuration and type of computing device, memory 1018 may be volatile (such as RAM, for example), non-volatile (such as ROM, flash memory, etc., for example) or some combination of the two. This configuration is illustrated in FIG. 10 by dashed line 1014.

In other embodiments, device 1012 may include additional features and/or functionality. For example, device 1012 may also include additional storage (e.g., removable and/or non-removable) including, but not limited to, magnetic storage, optical storage, and the like. Such additional storage is illustrated in FIG. 10 by storage 1020. In one embodiment, computer readable instructions to implement one or more embodiments provided herein may be in storage 1020. Storage 1020 may also store other computer readable instructions to implement an operating system, an application program, and the like. Computer readable instructions may be loaded in memory 1018 for execution by processing unit 1016, for example.

The term "computer readable media" as used herein includes computer storage media. Computer storage media includes volatile and nonvolatile, removable and non-removable media implemented in any method or technology for storage of information such as computer readable instructions or other data. Memory 1018 and storage 1020 are examples of computer storage media. Computer storage media includes, but is not limited to, RAM, ROM, EEPROM, flash memory or other memory technology, CD-ROM, Digital Versatile Disks (DVDs) or other optical storage, magnetic cassettes, magnetic tape, magnetic disk storage or other magnetic storage devices, or any other medium which can be used to store the desired information and which can be accessed by device 1012. Any such computer storage media may be part of device 1012.

Device 1012 may also include communication connection(s) 1026 that allows device 1012 to communicate with other devices. Communication connection(s) 1026 may include, but is not limited to, a modem, a Network Interface Card (NIC), an integrated network interface, a radio frequency transmitter/receiver, an infrared port, a USB connection, or other interfaces for connecting computing device 1012 to other computing devices. Communication connection(s) 1026 may include a wired connection or a wireless connection. Communication connection(s) 1026 may transmit and/or receive communication media.

The term "computer readable media" may include communication media. Communication media typically embodies computer readable instructions or other data in a "modulated data signal" such as a carrier wave or other transport mechanism and includes any information delivery media. The term "modulated data signal" may include a signal that has one or more of its characteristics set or changed in such a manner as to encode information in the signal.

Device 1012 may include input device(s) 1024 such as keyboard, mouse, pen, voice input device, touch input device, infrared cameras, video input devices, and/or any other input device. Output device(s) 1022 such as one or more displays, speakers, printers, and/or any other output device may also be included in device 1012. Input device(s) 1024 and output device(s) 1022 may be connected to device 1012 via a wired connection, wireless connection, or any combination thereof. In one embodiment, an input device or an output device from another computing device may be used as input device(s) 1024 or output device(s) 1022 for computing device 1012.

Components of computing device 1012 may be connected by various interconnects, such as a bus. Such interconnects may include a Peripheral Component Interconnect (PCI), such as PCI Express, a Universal Serial Bus (USB), firewire (IEEE 1394), an optical bus structure, and the like. In another embodiment, components of computing device 1012 may be interconnected by a network. For example, memory 1018 may be comprised of multiple physical memory units located in different physical locations interconnected by a network.

Those skilled in the art will realize that storage devices utilized to store computer readable instructions may be distributed across a network. For example, a computing device 1030 accessible via a network 1028 may store computer readable instructions to implement one or more embodiments provided herein. Computing device 1012 may access computing device 1030 and download a part or all of the computer readable instructions for execution. Alternatively, computing device 1012 may download pieces of the computer readable instructions, as needed, or some instructions may be executed at computing device 1012 and some at computing device 1030.

Various operations of embodiments are provided herein. In one embodiment, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each embodiment provided herein. Also, it will be understood that not all operations are necessary in some embodiments.

Further, unless specified otherwise, "first," "second," and/or the like are not intended to imply a temporal aspect, a spatial aspect, an ordering, etc. Rather, such terms are merely used as identifiers, names, etc. for features, elements, items, etc. For example, a first object and a second object generally correspond to object A and object B or two different or two identical objects or the same object.

Moreover, "exemplary" is used herein to mean serving as an example, instance, illustration, etc., and not necessarily as advantageous. As used herein, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B and/or the like generally means A or B or both A and B. Furthermore, to the extent that "includes", "having", "has", "with", and/or variants thereof are used in either the detailed description or the claims, such terms are intended to be inclusive in a manner similar to the term "comprising".

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A method for dispense event verification, comprising:

obtaining user identification information associated with a user attempting to invoke a dispenser to perform a dispense event of a hygiene material;

evaluating the user identification information against a dispense access model, wherein:

the dispense access model defines, for a first portion of a day, a first allowed level of access by the user to the dispenser, and defines, for a second portion of the day, a second allowed level of access by the user to the dispenser, the second portion of the day is different than the first portion of the day, the second allowed level of access is different than the first allowed level of access, and the evaluating comprises:

determining a present time of day;

determining whether the user is allowed to perform the dispense event based upon the first allowed level of access when the present time of day corresponds to the first portion of the day; and determining whether the user is allowed to perform the dispense event based upon the second allowed level of access when the present time of day corresponds to the second portion of the day;

responsive to the dispense access model indicating that the user is allowed to perform the dispense event, activating a pump to dispense the hygiene material;

responsive to the dispense access model indicating that the user is not allowed to perform the dispense event, restricting the dispense event; and responsive to the user attempting to perform a threshold number of dispense events within a timespan, restricting the user from utilizing the dispenser for a timeout timespan.

2. The method of claim 1, comprising:

establishing a communication connection with a computing device; and providing usage metrics of the dispenser over the communication connection to the computing device, the usage metrics comprising at least one of dispense event statistics, detected abuse, or an amount of remaining hygiene material.

3. The method of claim 1, comprising:

responsive to determining at least one of an attempted abuse of the dispenser, an unlocked status of the dispenser for a threshold timespan, or an actuation of the dispenser, providing at least one of a visible notification, an audible notification, an alarm trigger, or a lockout state for the dispenser.

4. The method of claim 1, wherein the hygiene material comprises soap.

5. The method of claim 1, wherein the hygiene material comprises hand sanitizer.

6. A system for dispense event verification, comprising:

a processor; and memory comprising instructions that when executed by the processor perform operations, the operations comprising:

obtaining user identification information associated with a user attempting to invoke a dispenser to perform a dispense event of a hygiene material;

evaluating the user identification information against a dispense access model;

responsive to the dispense access model indicating that the user is allowed to perform the dispense event:

facilitating the dispense event by providing the user with access for hygiene material retrieval; and responsive to determining that the user has removed a restricted hygiene material to which the user does not have permission to access, providing an alert specifying that attempted abuse has been detected;

responsive to the dispense access model indicating that the user is not allowed to perform the dispense event, restricting the dispense event; and responsive to the user attempting to perform a threshold number of dispense events within a timespan, restricting the user from utilizing the dispenser for a timeout timespan.

7. The system of claim 6, wherein the operations comprise:

defining a first rule specifying a first level of access for the user;

defining a second rule specifying a second level of access for a second user, the second level of access different than the first level of access; and including the first rule and the second rule within the dispense access model.

8. The system of claim 6, wherein:

the dispense access model defines, for a first portion of a day, a first allowed level of access by the user to the dispenser, and defines, for a second portion of the day, a second allowed level of access by the user to the dispenser, the second portion of the day is different than the first portion of the day, the second allowed level of access is different than the first allowed level of access, and the evaluating comprises:

determining a present time of day;

determining whether the user is allowed to perform the dispense event based upon the first allowed level of access when the present time of day corresponds to the first portion of the day; and determining whether the user is allowed to perform the dispense event based upon the second allowed level of access when the present time of day corresponds to the second portion of the day.

9. The system of claim 6, wherein:

the dispenser comprises an enclosure housing the hygiene material, and the operations comprise:

responsive to the dispense access model indicating that the user is allowed to perform the dispense event, providing the user with access inside the enclosure for the hygiene material retrieval.

10. The system of claim 9, wherein the operations comprise:

providing a second alert based upon the user maintaining access inside the enclosure for an amount of time that exceeds an access time limit.

11. The system of claim 6, wherein the operations comprise:

generating a user access metric for the user based upon interaction of the user with the dispenser; and providing the user access metric through a dispenser security interface.

12. The system of claim 6, wherein the operations comprise:

evaluating usage of the dispenser within a usage timespan to create a usage metric; and responsive to the usage metric being indicative of the attempted abuse, at least one of restricting the dispense event or providing a second alert.

13. The system of claim 6, wherein the operations comprise:

providing usage metrics of the dispenser, the usage metrics comprising at least one of dispense event statistics, detected abuse, or an amount of remaining hygiene material.

14. The system of claim 6, wherein the operations comprise:

responsive to determining at least one of the attempted abuse of the dispenser, an unlocked status of the dispenser for a threshold timespan, or an actuation of the dispenser, providing at least one of a visible notification, an audible notification, an alarm trigger, or a lockout state for the dispenser.

15. The system of claim 6, wherein the operations comprise:

providing a map depicting a location of the dispenser within a layout of a region within which the dispenser is disposed; and providing a notification within the map at the location of the dispenser responsive to at least one of the dispense access model indicating that the user is not allowed to perform the dispense event or the user attempting to perform the threshold number of dispense events within the timespan.

16. The system of claim 6, wherein the operations comprise:

monitoring a location of one or more hygiene materials within the dispenser using at least one of a camera or a radio frequency identification system mounted in the dispenser; and determining that the user has removed the restricted hygiene material to which the user does not have permission to access based upon the monitoring.

17. A computer readable medium comprising instructions which when executed perform operations for dispense event verification, the operations comprising:

obtaining user identification information associated with a user attempting to invoke a dispenser to perform a dispense event of a hygiene material;

evaluating the user identification information against a dispense access model, wherein:

the dispense access model defines, for a first portion of a day, a first allowed level of access by the user to the dispenser, and defines, for a second portion of the day, a second allowed level of access by the user to the dispenser, the second portion of the day is different than the first portion of the day, the second allowed level of access is different than the first allowed level of access, and the evaluating comprises:

determining a present time of day;

determining whether the user is allowed to perform the dispense event based upon the first allowed level of access when the present time of day corresponds to the first portion of the day; and determining whether the user is allowed to perform the dispense event based upon the second allowed level of access when the present time of day corresponds to the second portion of the day;

responsive to the dispense access model indicating that the user is allowed to perform the dispense event, triggering dispensing of the hygiene material; and responsive to the dispense access model indicating that the user is not allowed to perform the dispense event, restricting the dispense event.

18. The computer readable medium of claim 17, wherein the triggering comprises activating a pump to dispense the hygiene material from the dispenser.

19. The computer readable medium of claim 17, wherein the operations comprise:

responsive to the user attempting to perform a threshold number of dispense events within a timespan, restricting the user from utilizing the dispenser for a timeout timespan.

20. The computer readable medium of claim 17, wherein the hygiene material comprises at least one of soap or hand sanitizer.

* * * * *